US009834938B2

(12) United States Patent
Keene

(10) Patent No.: US 9,834,938 B2
(45) Date of Patent: Dec. 5, 2017

(54) RIDGE VENT

(71) Applicant: Keene Building Products Co., Inc., Mayfield Heights, OH (US)

(72) Inventor: James R. Keene, Pepper Pike, OH (US)

(73) Assignee: Keene Building Products Co., Inc., Mayfield Heights, OH (US)

( * ) Notice: Subject to any disclaimer, the term of this patent is extended or adjusted under 35 U.S.C. 154(b) by 966 days.

(21) Appl. No.: 13/719,708

(22) Filed: Dec. 19, 2012

(65) Prior Publication Data

US 2013/0178147 A1 Jul. 11, 2013

Related U.S. Application Data

(60) Provisional application No. 61/577,518, filed on Dec. 19, 2011.

(51) Int. Cl.
*E04D 13/17* (2006.01)

(52) U.S. Cl.
CPC ..... *E04D 13/176* (2013.01)

(58) Field of Classification Search
CPC ..... E06B 7/02; F24F 7/02; E04D 2001/342; E04D 2003/0806; E04D 13/176; E04D 3/3602; E04D 13/172; E04F 17/00; E04B 1/00; E04B 1/62; E04B 1/7069
USPC ..... 454/365, 367, 366, 370; 52/57, 198, 52/302.2, 302.6, 95, 169.4; 121/365, 366, 121/370
See application file for complete search history.

(56) References Cited

U.S. PATENT DOCUMENTS 3,598,688 A * 8/1971 Bellamy ..... E04D 5/12 428/315.5
4,237,672 A * 12/1980 Peterson ..... E04D 13/178 454/260
5,947,817 A * 9/1999 Morris ..... E04D 1/36 454/365
6,762,139 B2 * 7/2004 Strommen ..... B01J 20/20 428/107
7,384,331 B2 6/2008 Coulton
7,393,273 B2 7/2008 Ehrman et al.
8,024,897 B2 * 9/2011 Polumbus ..... E04D 13/174 52/198

(Continued)

FOREIGN PATENT DOCUMENTS

WO PCT/US2012/070540 2/2013

OTHER PUBLICATIONS

Unknown, "Cor-A-Vent V-300 & Fav-20 have all the angles covered", Cor-A-Vent, Inc. Dec. 2011 V-300Flier, © 2005, 4 pgs.

*Primary Examiner* — Gregory Huson
*Assistant Examiner* — Dana Tighe
(74) *Attorney, Agent, or Firm* — Renner, Otto, Boisselle & Sklar, LLP

(57) ABSTRACT

A ridge vent comprising: (a) a first filter clothe layer extending along a predetermined width and a predetermined length; (b) a first entangled net layer extending along the predetermined width and the predetermined length; and, (c) a second entangled net layer operatively coupled to the first entangled net layer, the second entangled net layer extending along the predetermined length and a first portion and a second portion of the predetermined width so as to provide an air void in a widthwise direction within the second entangled net layer that extends along the predetermined length.

28 Claims, 2 Drawing Sheets

(56) References Cited

U.S. PATENT DOCUMENTS

| | | | | |
|---|---|---|---|---|
| 2001/0032421 | A1* | 10/2001 | Rotter | F24F 7/02 52/198 |
| 2006/0096189 | A1* | 5/2006 | Pavlansky | E04D 13/174 52/198 |
| 2010/0144266 | A1* | 6/2010 | Lowe | F24F 7/02 454/365 |
| 2011/0189940 | A1 | 8/2011 | Kerwood-Winslow et al. | |

* cited by examiner

RIDGE VENT

CROSS REFERENCE TO RELATED APPLICATIONS

The present application claims the benefit of U.S. Provisional Patent Application Ser. No. 61/577,518, filed Dec. 19, 2011, the disclosure of each of which is hereby incorporated by reference.

RELATED ART

Field of the Invention

The present invention is directed to ventilation devices and associated methods and, more specifically, to vents that may be used and installed on the ridge of a building.

Brief Discussion of Related Art

In the art of making a roof there is a requirement that air flow from the attic to the exterior in order to lighten the cooling load in the summer months and to lower the temperature of the attic in the winter to more closely reflect the temperature in the outside. Cool attics help prevent ice dams. One of the most common methods of drawing the air from the attic is through a vent at the ridge of the roof. The product is called a ridge vent.

Others in the art have made an extruded ridge vent from a process of extruding filaments onto a geometrically shaped profile to create a three dimensional roll or mat. Typically between 100 and 1000 filaments are extruded over a four foot width with the filaments being between 0.25 mm and 1.5 mm in thickness. More often between 200 and 400 filaments of between 0.75 mm and 1.25 mm are extruded. Where the filaments touch one another they bond in order to create a single unified structure that can easily be placed, maneuvered, and rolled. This is often called an entangled net.

INTRODUCTION TO THE INVENTION

It is a first aspect of the present invention to provide a ridge vent comprising: (a) a first filter clothe layer extending along a predetermined width and a predetermined length; (b) a first entangled net layer extending along the predetermined width and the predetermined length; and, (c) a second entangled net layer operatively coupled to the first entangled net layer, the second entangled net layer extending along the predetermined length and a first portion and a second portion of the predetermined width so as to provide an air void in a widthwise direction within the second entangled net layer that extends along the predetermined length.

In a more detailed embodiment of the first aspect, the ridge vent further includes a second filter clothe layer operatively coupled to the first entangled net layer and interposing the second entangled net layer and the first entangled net layer, the second filter clothe layer extending along the predetermined length and the first portion and the second portion of the predetermined width so as to maintain the gap in a widthwise direction within the second filter clothe layer. In yet another more detailed embodiment, the ridge vent further includes a first adhesive layer interposing the first entangled net layer and the second entangled net layer. In a further detailed embodiment, the first entangled net layer comprises a plurality of filaments having a dimension between approximately 0.25 mm and 1.5 mm. In still a further detailed embodiment, the first entangled net layer has a thickness ranging between 0.25 inches and 0.5 inches. In a more detailed embodiment, the second entangled net layer has a thickness ranging between 0.25 inches and 0.5 inches. hi a more detailed embodiment, the first entangled net layer is fabricate from a first polymer, and the second entangled net layer is fabricated from a second polymer. In another more detailed embodiment, the first polymer comprises at least one of an olefin, a polyamide, a polyvinyl chloride, and a polyethylene terephthalate, and the second polymer comprises at least one of an olefin, a polyamide, a polyvinyl chloride, and a polyethylene terephthalate. In yet another more detailed embodiment, the predetermined width is between eight and twelve inches, and the predetermined length is greater than twenty feet. In still another more detailed embodiment, the ridge vent further includes a second filter clothe layer operatively coupled to the second entangled net layer, opposite the first entangled net layer, the second filter clothe layer and the first entangled net layer and the second entangled net layer circumscribing the air void in the widthwise direction.

It is a second aspect of the present invention to provide a ridge vent comprising: (a) a first entangled net layer extending along a predetermined width and a predetermined length; and, (b) a second entangled net layer operatively coupled to the first entangled net layer, the second entangled net layer including a first segment extending along the predetermined length and a first subset of the predetermined width, the second entangled net layer including a second segment extending along the predetermined length and a second subset of the predetermined width, the second entangled net layer including an air void that interposes the first segment and the second segment, the air void extending along the predetermined length and a third subset of the predetermined width, where the first subset, the second subset, and the third subset is no more than 1.5 times the predetermined width.

In a more detailed embodiment of the second aspect, the ridge vent further includes a filter clothe layer operatively coupled to the first entangled net layer and extending along the predetermined length and the predetermined width. In yet another more detailed embodiment, the ridge vent further includes a first adhesive layer interposing the first entangled net layer and the second entangled net layer. In a further detailed embodiment, the first entangled net layer comprises a plurality of filaments having a dimension between approximately 0.25 mm and 1.5 mm. In still a further detailed embodiment, the first entangled net layer has a thickness ranging between 0.25 inches and 0.5 inches. In a more detailed embodiment, the second entangled net layer has a thickness ranging between 0.25 inches and 0.5 inches. In a more detailed embodiment, the first entangled net layer is fabricate from a first polymer, and the second entangled net layer is fabricated from a second polymer. In another more detailed embodiment, the first polymer comprises at least one of an olefin, a polyamide, a polyvinyl chloride, and a polyethylene terephthalate, and the second polymer comprises at least one of an olefin, a polyamide, a polyvinyl chloride, and a polyethylene terephthalate. In yet another more detailed embodiment, the predetermined width is between eight and twelve inches, and the predetermined length is greater than twenty feet. In still another more detailed embodiment, the ridge vent further includes a filter clothe layer operatively coupled to the second entangled net layer, opposite the first entangled net layer, the filter clothe layer and the first entangled net layer and the second entangled net layer circumscribing the air void in a widthwise direction. In still another more detailed embodiment, the ridge vent further includes a first filter clothe layer operatively coupled to the first entangled net layer and extending along the predetermined length and the predetermined width, and a second filter clothe layer interposing the first entangled net layer and the second entangled net layer. In a further detailed embodiment, the ridge vent further includes a third filter clothe layer operatively coupled to the second entangled net layer, opposite the first entangled net layer, the third filter clothe layer and the first entangled net layer and the second entangled net layer circumscribing the air void in a widthwise direction.

DETAILED DESCRIPTION

The exemplary embodiments of the present disclosure are described and illustrated below to encompass ventilation devices and associated methods of fabricating ad using the same and, more specifically, to vents that may be used and installed on the ridge of a building. Of course, it will be apparent to those of ordinary skill in the art that the embodiments discussed below are exemplary in nature and may be reconfigured without departing from the scope and spirit of the present disclosure. However, for clarity and precision, the exemplary embodiments as discussed below may include optional steps, methods, and features that one of ordinary skill should recognize as not being a requisite to fall within the scope of the present disclosure.

Figure 1:
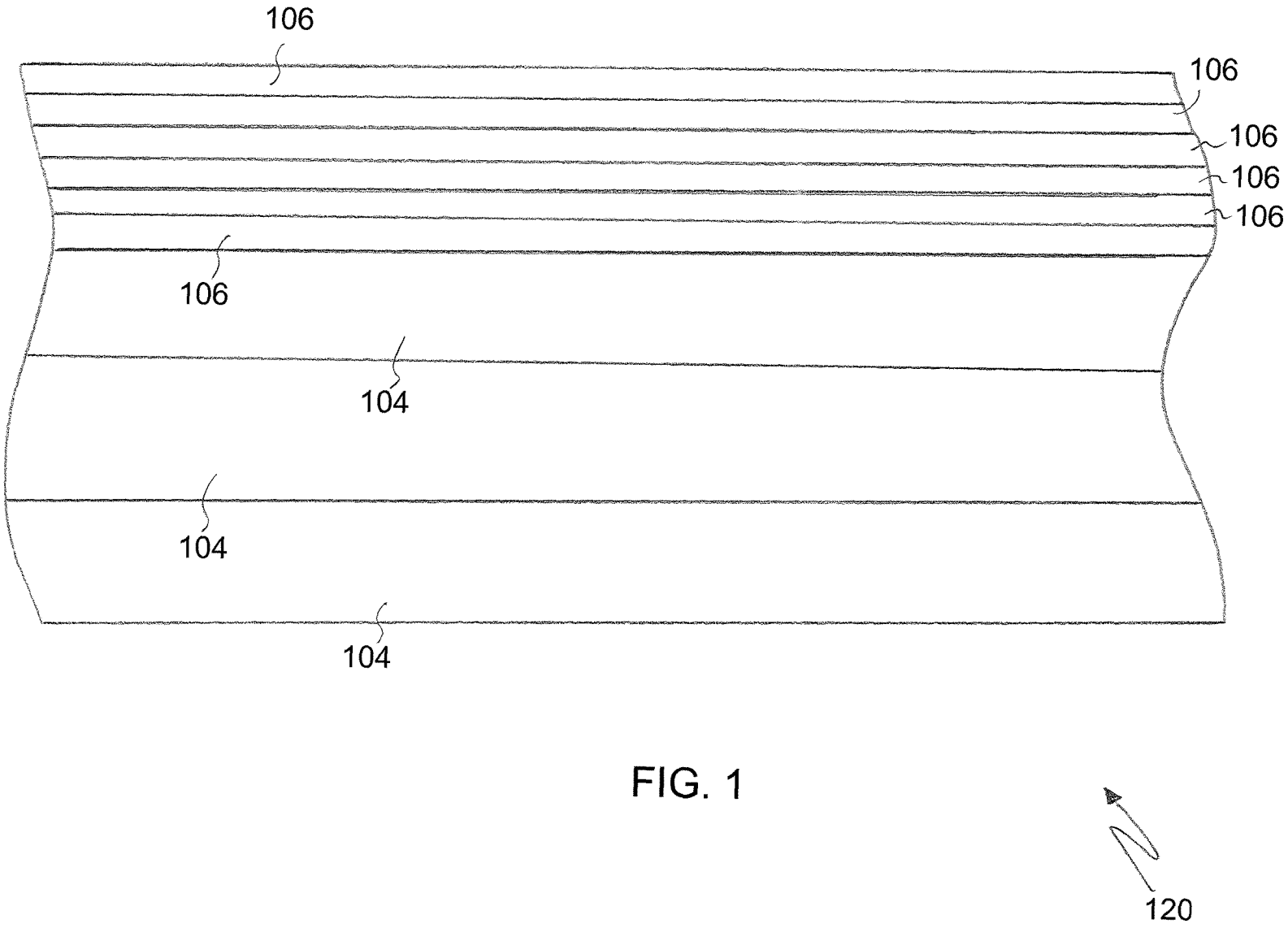
FIG. 1 is a top view of an entangled net matt section having been cut into longitudinal segments.
Figure 2:
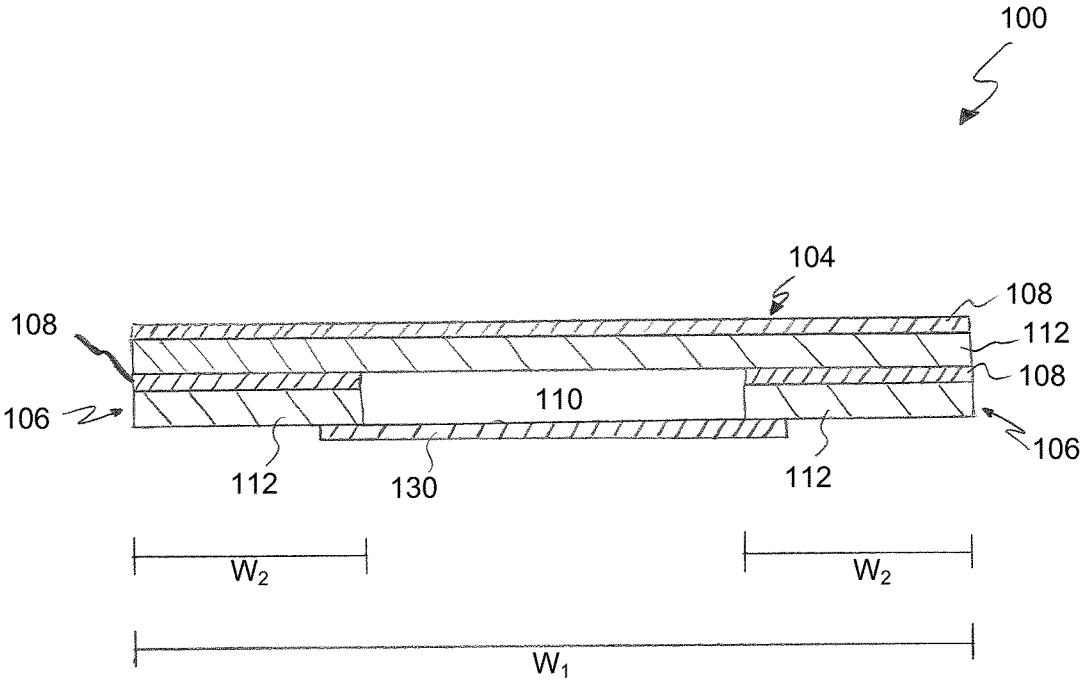
FIG. 2 is a cross-sectional view of an exemplary ridge vent.

Referencing FIGS. 1 and 2, an exemplary ridge vent 100 comprises a plurality of entangled net mats laminated together. The exemplary ridge vent 100 incorporates thicknesses of an entangled net mat 102 that would not traditionally meet the required thickness of approximately 0.625 inches for a ridge vent and laminates these mats together in a manner that enhances air flow and rigidity, while still creating a filtered and ventilated roof vent. Additionally, an exemplary method of manufacturing the ridge vent 100 is simplified by producing a sheet that can be slit and stacked in order to create the appropriate material thickness.

Standard ridge vents are typically: (1) in a roll about 25 feet in length; (2) between 7.0 inches and 12.0 inches in width; and, (3) between 0.5 inches and 1.0 inches in thickness.

An exemplary process to fabricate the ridge vent 100 makes use of a standard roll of entangled net mat 120 having a width of approximately 48 inches and a thickness of approximately 0.32 inches. The standard roll is cut longitudinally to create three strips 104 each having a width $W_1$ of approximately 10.5 inches and six strips 106 each having a width $W_2$ of approximately 2.75 inches. Each strip 104, 106 includes a filter clothe backer 108, which is mounted to an entangled net layer 112, having an AOS size that allows for a free flow of air. After the strips 104, 106 have been cut from the standard roll, the two strips 106 are adhered to each wider strip 104 so that the edges of the strips are aligned, as shown in FIG. 2. The strips may be adhered using any commercially available adhesive or other means of adherence. In sum, the standard 48 inch roll of entangled net mat provides enough material to create three ridge vents 100 having the exemplary dimensions shown in FIG. 2.

This exemplary ridge vent 100 has a flow path from the edge to the center. This is the result of edges having a greater thickness (0.625 inches) as opposed to the center section having a thickness of only 0.32 inches. As a result, a central void 110 is created that enhances air flow.

The exemplary ridge vent 100 may also include an additional filter clothe layer 130 that is mounted to the entangled net layer 112 of the strips 106 in order to circumscribe or box in the central air void 110 in the widthwise dimension. In such a circumstance, the filter clothe layer 130 as a length that is substantially the same as that of the entangled net layers 112.

The exemplary ridge vent 100 may take on other exemplary dimensions and have other exemplary configurations all encouraging airflow to the center without the obstruction of a filter. It should be understood, however, that the exemplary ridge vent need not include a center void to fall within the scope of the disclosure as two strips of entangled mats having the same width may be laminated to one another.

Following from the above description and invention summaries, it should be apparent to those of ordinary skill in the art that, while the methods and apparatuses herein described constitute exemplary embodiments of the present invention, the invention is not limited to the foregoing and changes may be made to such embodiments without departing from the scope of the invention as defined by the claims. Additionally, it is to be understood that the invention is defined by the claims and it is not intended that any limitations or elements describing the exemplary embodiments set forth herein are to be incorporated into the interpretation of any claim element unless such limitation or element is explicitly stated. Likewise, it is to be understood that it is not necessary to meet any or all of the identified advantages or objects of the invention disclosed herein in order to fall within the scope of any claims, since the invention is defined by the claims and since inherent and/or unforeseen advantages of the present invention may exist even though they may not have been explicitly discussed herein.

What is claimed is:

1. A ridge vent comprising: a first filter clothe layer extending along a predetermined width and a predetermined length; a ventilated first entangled net layer adjacent to the first filter clothe layer and extending along the predetermined width and the predetermined length; a second entangled net layer operatively coupled to the ventilated first entangled net layer, the second entangled net layer extending along the predetermined length and a first portion and a second portion of the predetermined width; an air void extending along the predetermined length and a third portion of the predetermined width between the first portion and the second portion, the air void abutting the ventilated first entangled net layer, the second entangled net layer that extends along the first portion of the predetermined width, and the second entangled net layer that extends along the second portion of the predetermined width; and a second filter clothe layer operatively coupled to the first entangled net layer and interposing the second entangled net layer and the first entangled net layer, the second filter clothe layer extending along the predetermined length and the first portion and the second portion of the predetermined width so as to maintain a gap in a widthwise direction within the second filter clothe layer.

2. The ridge vent of claim 1, further comprising a first adhesive layer interposing the first entangled net layer and the second entangled net layer.

3. The ridge vent of claim 1, wherein the first entangled net layer comprises a plurality of filaments having a dimension between approximately 0.25 mm and 1.5 mm.

4. The ridge vent of claim 1, wherein the first entangled net layer has a thickness ranging between 0.25 inches and 0.5 inches.

5. The ridge vent of claim 4, wherein the second entangled net layer has a thickness ranging between 0.25 inches and 0.5 inches.

6. The ridge vent of claim 1, wherein: the first entangled net layer is fabricated from a first polymer; and the second entangled net layer is fabricated from a second polymer.

7. The ridge vent of claim 6, wherein: the first polymer comprises at least one of an olefin, a polyamide, a polyvinyl chloride, and a polyethylene terephthalate; and, the second polymer comprises at least one of an olefin, a polyamide, a polyvinyl chloride, and a polyethylene terephthalate.

8. The ridge vent of claim 1, wherein: the predetermined width is between eight and twelve inches; and, the predetermined length is greater than twenty feet.

9. The ridge vent of claim 1, further comprising a third filter clothe layer operatively coupled to the second entangled net layer, opposite the first entangled net layer, the third filter clothe layer and the first entangled net layer and the second entangled net layer circumscribing the air void in the widthwise direction.

10. The ridge vent of claim 1, wherein the first portion, the second portion, and the third portion is no more than 1.5 times the predetermined width.

11. A ridge vent comprising: a ventilated first entangled net layer extending along a predetermined width and a predetermined length; a second entangled net layer operatively coupled to the ventilated first entangled net layer, the second entangled net layer including a first segment extending along the predetermined length and a first subset of the predetermined width, the second entangled net layer including a second segment extending along the predetermined length and a second subset of the predetermined width; an air void that interposes the first segment and the second segment, the air void extending along the predetermined length and a third subset of the predetermined width and abutting the ventilated first entangled net layer, the first segment, and the second segment; and a first filter clothe layer operatively coupled to the second entangled net layer, opposite the first entangled net layer, the first filter clothe layer and the first entangled net layer and the second entangled net layer circumscribing the air void in a widthwise direction, wherein the first subset, the second subset, and the third subset is no more than 1.5 times the predetermined width.

12. The ridge vent of claim 11, further comprising a first adhesive layer interposing the first entangled net layer and the second entangled net layer.

13. The ridge vent of claim 11, wherein the first entangled net layer comprises a plurality of filaments having a dimension between approximately 0.25 mm and 1.5 mm.

14. The ridge vent of claim 11, wherein the first entangled net layer has a thickness ranging between 0.25 inches and 0.5 inches.

15. The ridge vent of claim 14, wherein the second entangled net layer has a thickness ranging between 0.25 inches and 0.5 inches.

16. The ridge vent of claim 11, wherein: the first entangled net layer is fabricated from a first polymer; and the second entangled net layer is fabricated from a second polymer.

17. The ridge vent of claim 16, wherein: the first polymer comprises at least one of an olefin, a polyamide, a polyvinyl chloride, and a polyethylene terephthalate; and, the second polymer comprises at least one of an olefin, a polyamide, a polyvinyl chloride, and a polyethylene terephthalate.

18. The ridge vent of claim 11, wherein: the predetermined width is between eight and twelve inches; and, the predetermined length is greater than twenty feet.

19. The ridge vent of claim 11, further comprising: a second filter clothe layer operatively coupled to the first entangled net layer and extending along the predetermined length and the predetermined width; and a third filter clothe layer interposing the first entangled net layer and the second entangled net layer.

20. A ridge vent comprising: a first filter clothe layer extending along a predetermined width and a predetermined length; a ventilated first entangled net layer adjacent to the first filter clothe layer and extending along the predetermined width and the predetermined length; a second entangled net layer operatively coupled to the ventilated first entangled net layer, the second entangled net layer extending along the predetermined length and a first portion and a second portion of the predetermined width; an air void extending along the predetermined length and a third portion of the predetermined width between the first portion and the second portion, the air void abutting the ventilated first entangled net layer, the second entangled net layer that extends along the first portion of the predetermined width, and the second entangled net layer that extends along the second portion of the predetermined width; and a second filter clothe layer operatively coupled to the second entangled net layer, opposite the first entangled net layer, the second filter clothe layer and the first entangled net layer and the second entangled net layer circumscribing the air void in the widthwise direction.

21. The ridge vent of claim 20, further comprising a first adhesive layer interposing the first entangled net layer and the second entangled net layer.

22. The ridge vent of claim 20, wherein the first entangled net layer comprises a plurality of filaments having a dimension between approximately 0.25 mm and 1.5 mm.

23. The ridge vent of claim 20, wherein the first entangled net layer has a thickness ranging between 0.25 inches and 0.5 inches.

24. The ridge vent of claim 23, wherein the second entangled net layer has a thickness ranging between 0.25 inches and 0.5 inches.

25. The ridge vent of claim 20, wherein: the first entangled net layer is fabricated from a first polymer; and the second entangled net layer is fabricated from a second polymer.

26. The ridge vent of claim 25, wherein: the first polymer comprises at least one of an olefin, a polyamide, a polyvinyl chloride, and a polyethylene terephthalate; and, the second polymer comprises at least one of an olefin, a polyamide, a polyvinyl chloride, and a polyethylene terephthalate.

27. The ridge vent of claim 20, wherein: the predetermined width is between eight and twelve inches; and, the predetermined length is greater than twenty feet.

28. The ridge vent of claim 20, wherein the first portion, the second portion, and the third portion is no more than 1.5 times the predetermined width.

* * * * *